US006032395A

United States Patent [19]

Bentley et al.

[11] Patent Number: 6,032,395

[45] Date of Patent: Mar. 7, 2000

[54] MAGAZINE LOADED PUMP ACTION SHOTGUN

[76] Inventors: James K Bentley, 2489 Starling Dr., Paso Robles, Calif. 93446; Willard H Crawford, 1836 Orange Street, Bakersfield, Calif. 93004

[21] Appl. No.: 09/105,953

[22] Filed: Jun. 26, 1998

Related U.S. Application Data

[63] Continuation-in-part of application No. 08/559,842, Nov. 20, 1995, Pat. No. 5,771,620.

[51] Int. Cl.[7] ..... F41B 3/66

[52] U.S. Cl. ..... 42/19; 42/25; 89/33.02

[58] Field of Search ..... 89/33.1, 33.5, 89/33.02; 42/17, 19, 21, 25

[56] References Cited

U.S. PATENT DOCUMENTS

| | | | |
|---|---|---|---|
| H211 | 2/1987 | Vanderbeck | 42/17 |
| 3,172,222 | 3/1965 | Vartanian | 42/21 |
| 3,421,408 | 1/1969 | Badali et al. | 89/33.1 |
| 3,990,169 | 11/1976 | Jennie et al. | 42/17 |
| 4,058,923 | 11/1977 | Smith | 42/17 |

FOREIGN PATENT DOCUMENTS

| | | | |
|---|---|---|---|
| 80161 | 5/1919 | Austria | 42/19 |

*Primary Examiner*—Stephen M. Johnson
*Attorney, Agent, or Firm*—Charles C. Logan II

[57] ABSTRACT

A pump action shotgun that has been designed to accept a shotgun shell magazine that can be quickly and easily attached or removed. An aperture is formed in the bottom surface of the receiver forwardly of a trigger housing assembly aperture. The top end of the magazine has a feed lip assembly that restricts the upward travel of the shotgun shells prior to their being transported to the rear end of the gun barrel by the bolt assembly as it travels forwardly. A spring loaded tang extends downwardly from the front bottom surface of the bolt assembly and travels through the feed lip assembly where it engages the rear end of the upper most shotgun shells and carries it forwardly to the rear end of the gun barrel. A bolt slide that is detachably secured to the bottom surface of the bolt assembly has a concave bottom surface that allows it to travel forwardly and rearwardly over the top of the feed lip assembly of the shotgun shell magazine. A unique winged ramp assembly prevents the shotgun shells from jamming the shotgun as they travel into the rear end of the gun barrel.

11 Claims, 7 Drawing Sheets

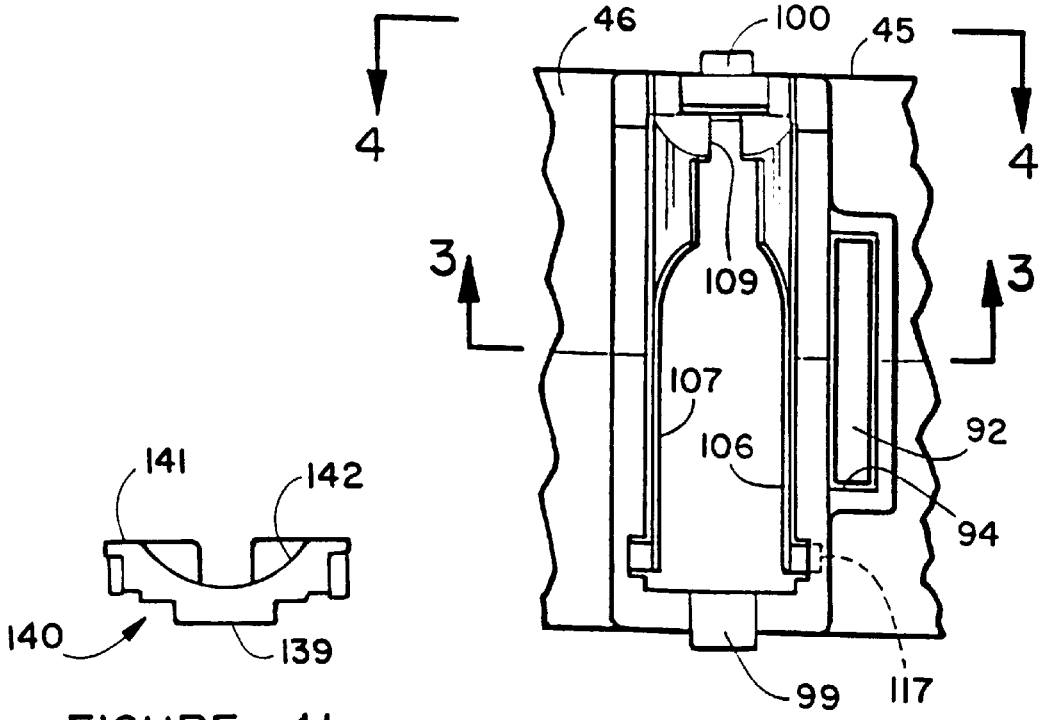
FIGURE 2
FIGURE 11
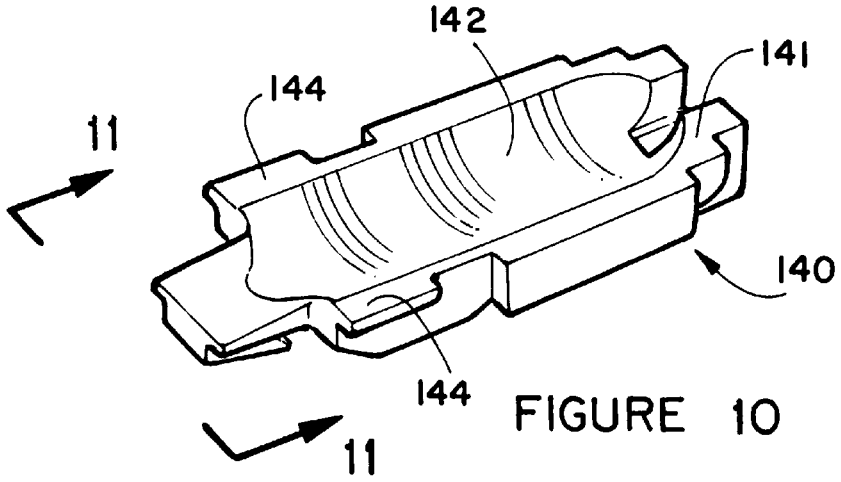
FIGURE 10

MAGAZINE LOADED PUMP ACTION SHOTGUN

This patent application is a continuation-in-part of U.S. application Ser. No. 08/559,842 filed on Nov. 20, 1995 now U.S. Pat. No. 5,771,620 issued on Jun. 30, 1998.

BACKGROUND OF THE INVENTION

The invention relates to shotguns and more specifically to pump action shotguns.

Presently pump action shotguns have structure which restricts the number of shotgun shells that can be loaded in its magazine tube to five shells. When all five shells have been fired, it is necessary to turn the shotgun over and physically load one shell at a time into the magazine tube. This is an unreasonable delay when the weapon is in the hands of a military person in a life threatening situation. The same problem would exist for police officers or swat team members that use the pump action shotgun. The prolonged period for reloading the shotgun also affects skeet shooters when competing in a competition.

The ramp positioned adjacent the front end of the magazine aperture in U.S. Pat. No. 5,771,620 does not always transport the shotgun shell to the center of the chamber at the rear of the gun barrel. The axial length of the ramp is very short (approximately ½ inch due to the shortness of the receiver in a shotgun and additionally because the shotgun shells are approximately 3 inches long). The shotgun shell as it travels forwardly from the shotgun magazine only briefly contacts the ramp and then essentially bounces up toward the chamber at the rear of the gun barrel. If the shotgun shell wobbles transversely during forward travel it can catch on the side of the chamber and jam the shotgun.

It is an object of the invention to provide a novel pump action shotgun that is capable of operating with a shotgun shell magazine that can be quickly and easily attached and removed from the shotgun.

It is also an object of the invention to provide a novel pump action shotgun in which the top end of the shotgun shell magazine is inserted into an aperture in the bottom surface of the receiver of the shotgun.

It is another object of the invention to provide a novel pump action shotgun that eliminates several moving parts that are normally found in the receiver of present day shotguns.

It is an additional object of the invention to provide a novel pump action shotgun that eliminates the need for conventional components in the magazine tube located beneath the gun barrel.

It is a further object of the invention to provide a novel pump action shotgun that is economical to manufacture and market.

It is also an object of the invention to provide a novel structure for feeding the shotgun shells from a magazine to the chamber.

It is another object of the invention to provide a novel winged ramp assembly for positively guiding a shotgun shell from the top of the shotgun shell magazine into its proper position in the rear chamber of the gun barrel prior to its being fired.

SUMMARY OF THE INVENTION

The novel pump action shotgun has been designed to eliminate a great deal of the structure in the receiver of a conventional pump action shotgun. The elevator structure, the cartridge stop and cartridge interrupter are eliminated and this is a constant source of problems when dirt gets into the receiver and disturbs the timing of different movable parts with respect to each other. Also eliminated are the two buttons, spring and rod normally required in the magazine tube.

The shotgun has been designed to detachably receive a shotgun shell magazine having a centrally positioned upstanding chimney portion. A feed lip assembly is pivotally secured to the top edge of the chimney portion of the shotgun shell magazine. The top end of the chimney portion of the shotgun shell magazine is detachably received in an aperture in the bottom surface of the receiver. This aperture is spaced forwardly of the trigger housing assembly.

The structure of the feed lip assembly is entirely received in the interior of the receiver. It has a vertical slot formed in its rear wall that communicates with the rear surface of the uppermost shotgun shell in the shotgun shell magazine. A ramp is positioned adjacent the front end of the magazine aperture and it extends upwardly toward the rear end of the gun barrel.

The forearm of the shotgun is secured to the action slide assembly. The slide action assembly has a pair of laterally spaced arms that extend rearwardly into the receiver and they have recesses in their bottom surface adjacent their ends that detachably receive the respective transversely extending wings on the bolt slide. The bolt slide is detachably secured to the bottom surface of the bolt assembly. The front end of the bolt assembly has a firing pin and laterally extending ejectors that detachably receive the rear flange on a shotgun shell for ejecting it after it has been fired. A spring loaded tang extends downwardly and forwardly from the bottom surface of the bolt assembly adjacent its front end.

When the operator of the pump action shotgun pulls the forearm rearwardly, the laterally spaced slide action arms transmit the bolt slide rearwardly along with the bolt assembly which is secured thereto. The tang is depressed upwardly into a recess in the bolt assembly as it travels over the top surface of the shotgun shell positioned in the feed lip assembly. Once the forearm has reached its rearwardly most position, the operator pulls it forwardly at which time the tang has cleared the rear end of the feed lip assembly and thus extends downwardly from the bottom surface of the bolt assembly. The tang passes through the slot in the rear wall of the feed lip assembly and contacts the uppermost shotgun shell and pulls it forwardly. As the front end of the shotgun shell exits the feed lip assembly, it is directed upwardly by the novel winged ramp assembly located at the forward end of the magazine aperture. The winged ramp assembly has laterally spaced left and right guide wing portions extending upwardly from the respective left and right edges of the concave top surface of the ramp body portion. These guide wing portions extend upwardly to the bottom of the chamber at the rear of the gun barrel and prevent the shotgun shell from getting sideways and jamming the shotgun. The shell is thus directed toward the rear end of the gun barrel and inserted therein. The concave bottom surface of the bolt slide allows it to travel over the top of the feed lip assembly as it travels forwardly at this time. The shotgun can then be fired and the forearm would be pulled rearwardly to eject the spent shell and the previously described operation would reoccur. The novel shotgun could also be modified to function as a semi-automatic weapon by using gas power instead of hand power to move the forearm rearwardly and forwardly.

DESCRIPTION OF THE DRAWINGS

FIG. 2 is a partial top plan view of the magazine illustrating the interior of the chimney section;

FIG. 10 is a perspective view of the bolt slide shown in an upside down position;

FIG. 11 is a elevation view taken along lines 7—7 of FIG. 10;

DESCRIPTION OF THE PREFERRED EMBODIMENT

Figure 1:
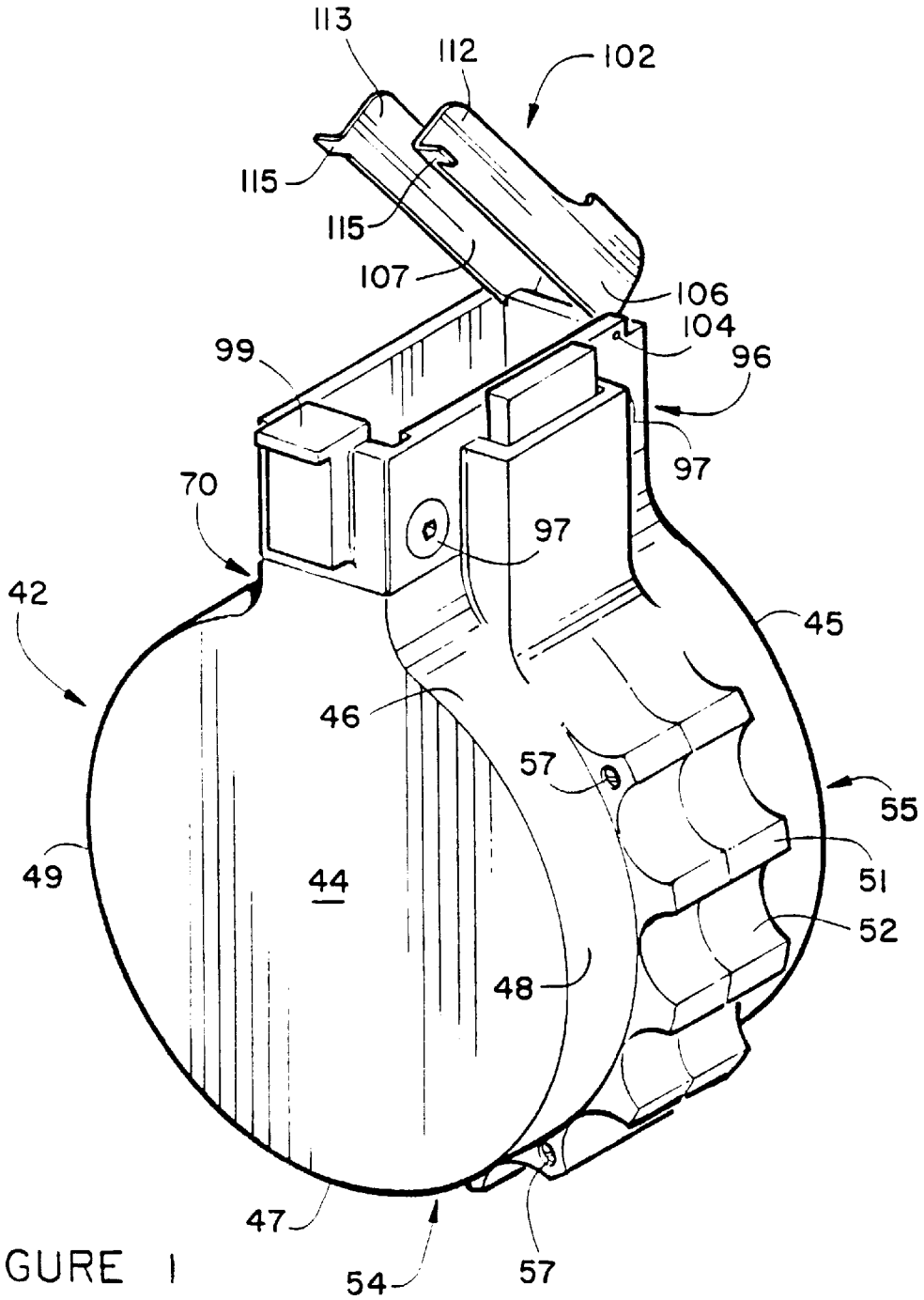
FIG. 1 is a front perspective view of the magazine used with the novel pump action shotgun.
Figure 4:
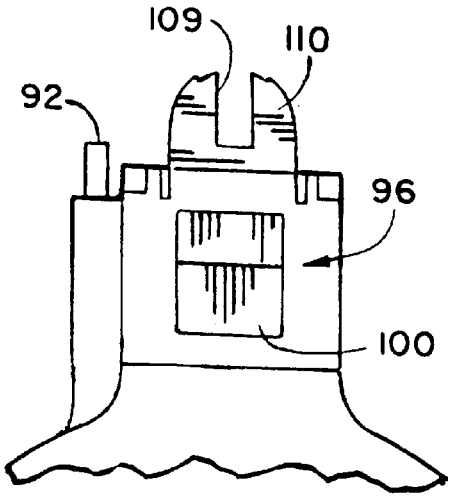
FIG. 4 is a partial rear elevation view of the magazine and more specifically its chimney section.
Figure 3:
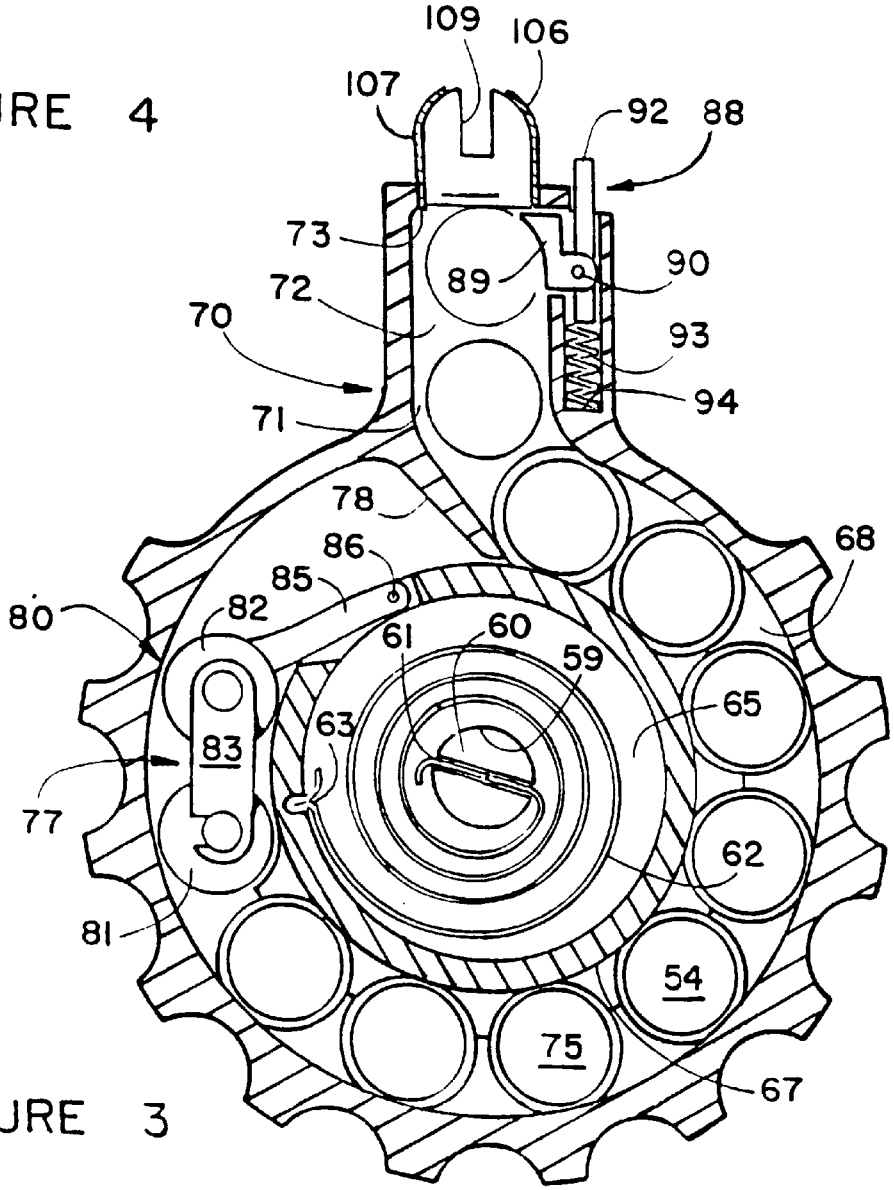
FIG. 3 is a cross sectional view taken along lines 3—3 of FIG. 2.
Figure 5:
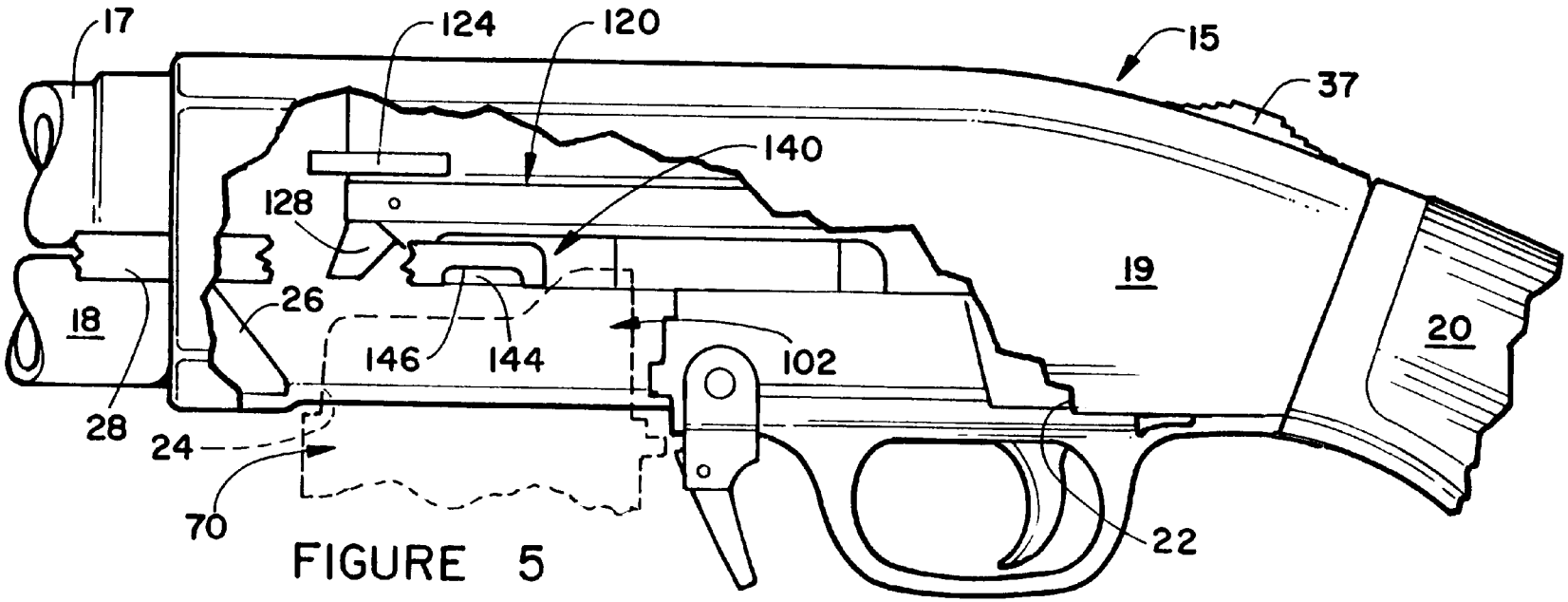
FIG. 5 is a partial side elevation view of the novel pump action shotgun with portions broken away.
Figure 6:
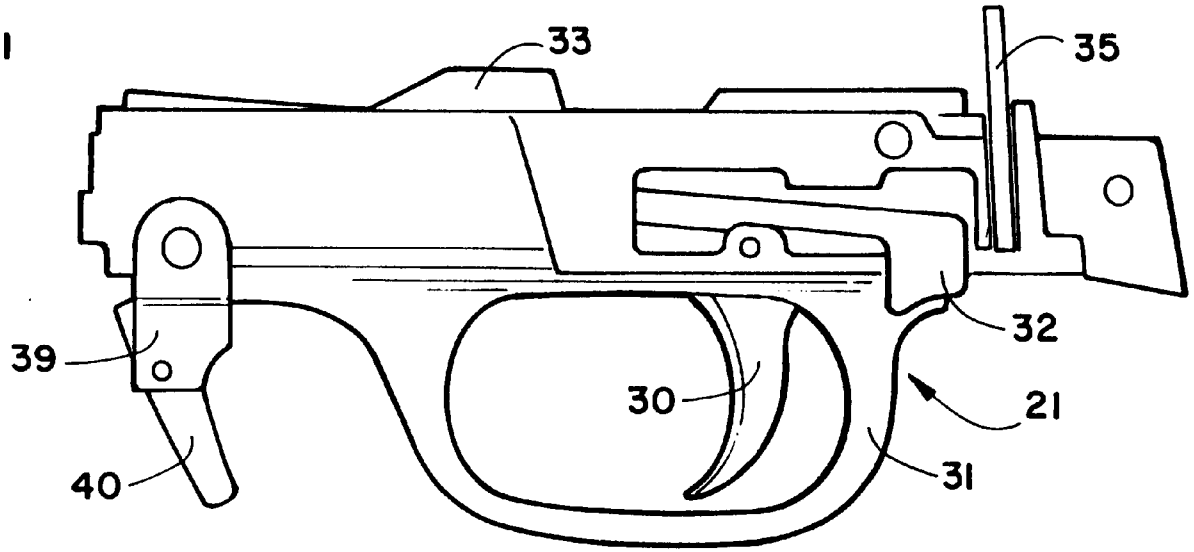
FIG. 6 is a side elevation of the trigger housing assembly.

The novel pump action shotgun will now be described by referring to FIGS. 1–11 of the drawings. The shotgun is generally designated numeral 15. It has a gun barrel 17, a magazine tube 18, a receiver 19 and a stock 20. A trigger housing assembly 21 is removably received in an aperture 22 in the bottom surface of receiver 19. A magazine aperture 24 is also formed in the bottom surface of receiver 19. A ramp 26 having a longitudinally extending concave top surface is positioned adjacent the front end of magazine aperture 24 and its top end travels up to the rear end of gun barrel 17. A forearm (not show) is attached to the front end of an action slide assembly whose laterally spaced slide actions arms 28 extend rearwardly into the interior of receiver 19 (see FIG. 5).

Trigger housing assembly 21 (see FIG. 6) has a trigger 30, a trigger guard 31, a bolt release lever 32, and a hammer 33. A safety post 35 extends upwardly and is detachably received in the bottom end of safety button 37. A bracket 39 extends downwardly from the front end of trigger housing assembly 21 and it has a spring loaded latch 40 pivotally secured thereto.

The shotgun shell magazine that is used with the novel shotgun 15 is best illustrated in FIGS. 1–4 and it is also the subject of a copending patent application. The magazine is generally designated numeral 42 and it has a front wall 44, a rear wall 45, the top wall 46, a bottom wall 47, a left side wall 48 and a right side wall 49. Finger-gripping ridges 51 separated by concave recesses 52 are formed on the outer surface of the housing of shotgun shell magazine 42. The housing is preferably formed from molded plastic and it has a front half 54 and a rear half 55. Screws 57 secure the two halves together.

The inner structure of front half 54 and the rear half 55 are substantially the same but reversed in their orientation. A recess 59 is formed on the inner surface of each of the respective front and rear walls 44 and 45 and they receive the opposite ends of rod 60. Rod 60 has a longitudinally extending slot 61 for receiving one end of a flat coiled spring 62 whose opposite end is captured in notch 63. The inner surfaces of these respective walls each have an inwardly extending boss 65 that fits into the opposite ends of a tubular drum 67 which is journaled thereon for rotational travel. An annular chamber 68 on a circular axis is formed between the outer surface of tubular drum 67 and the inner surface of front wall 44, rear wall 45, top wall 46, bottom wall 47, left side wall 48 and right side wall 49. Chimney section 70 has an inlet port 71, a linear chamber 72, and an outlet port 73.

Tubular drum 67 has a pair of laterally spaced cog gears formed on its outer surface whose structure functions to capture shotgun shells 75 so they can be carried along annular chamber 68 toward inlet port 71 of chimney section 70 as drum 67 rotates. Tubular drum 67 is spring loaded to rotate with respect to the front and rear walls of the housing. When shotgun shell magazine 42 is loaded, shotgun shells 75 are continuously inserted into chimney section 70 and as the shells engage the cog gears, tubular drum 67 is caused to rotate until the rear end of shell ammunition follower 77 rotates into contact with a stop limit wall 78 that extends into annular chamber 68. This limits the rotational travel of tubular drum 67 to less then 360 degrees. Shell ammunition follower assembly 77 is in the form of an articulated carriage 80 having a pair of laterally spaced rollers 81 and 82 secured together by a connecting member 83. An elevator arm 85 has its front end connected to roller 82 and its rear end connected by a pivot pin 86 to tubular drum 67. Elevator arm 85 pushes shell ammunition follower assembly 77 along a rotational path through the annular chamber 68 and then lifts the shell ammunition follower assembly 77 along a vertical linear path through the linear extending chamber 72 of chimney section 70 to its outlet port 73.

The shotgun shell magazine has a shell retainer unit 88 mounted in chimney section 70 for preventing shotgun shells 75 from exiting outlet port 73 when the magazine is detached from the shotgun. Shell retainer unit 88 has a spring loaded retainer lip 89 that is biased to block the outlet port 73 of chimney section 70 when the magazine is not attached to a firearm. Spring loaded retainer lip 89 is pivotally mounted by pin 90 on depressor member 92. The bottom end of depressor member 92 is in contact with spring 93 that is positioned in groove 94.

When chimney section 70 of the shotgun shell magazine is inserted into the bottom end of the receiver of a shotgun, the bottom edges of the receiver will force depressor member 92 downwardly. This causes feed retainer lip 89 to be withdrawn from the outlet port 73 and allows the shotgun shells 75 to pass through the outlet port 73 and into the shotgun where they may be fired.

A metal band 96 is secured to the outer surface of chimney 70 by screws 97. Front locking lug 99 and a rear locking lug 100 extend from the respective front and rear ends of metal band 96. These are captured by cooperating structure on the bottom of the receiver of the pump action shotgun.

A feed lip assembly 102 has its rear end pivotally secured by pins 104 to the top end of metal band 96. Feed lip assembly 102 has a left side wall 106, a right side wall 107, and they upper portions that curve inwardly toward each other. A slot 109 is formed in rear wall 110 and it allows the tang on the bolt assembly of the shotgun to pass therethrough and deliver the shotgun shell into the barrel of the gun where it is fired. Spring arms 112 and 113 extend forwardly from the respective side walls 106 and 107. Tabs 115 extend transversely from the respective spring arms and they are received in recesses 117 of the respective left and right side walls of the chimney 70.

Figure 8:
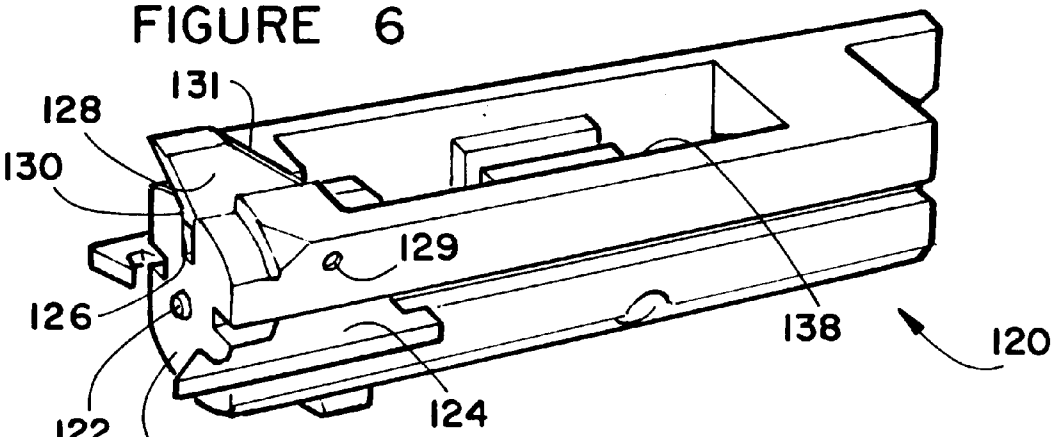
FIG. 8 is a perspective view illustrating the bolt assembly in its upside down position.
Figure 7:
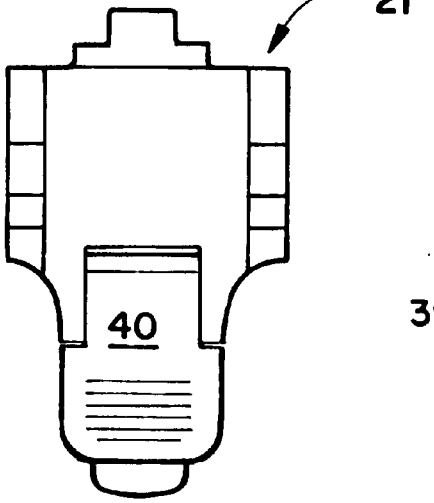
FIG. 7 is a front elevation view of the trigger housing assembly.
Figure 9:
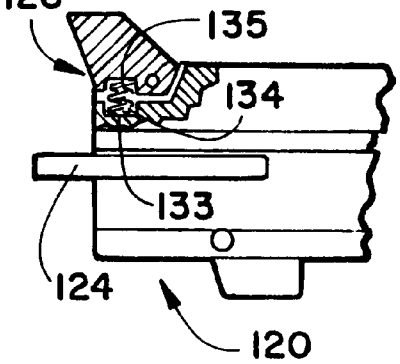
FIG. 9 is a front elevation view taken along FIG. 8.
Figure 13:
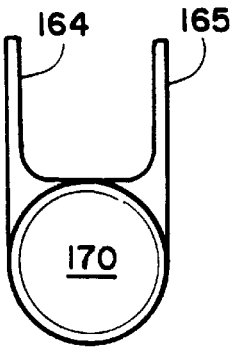
FIG. 13 is a rear elevation view of the novel winged ramp assembly.
Figure 14:
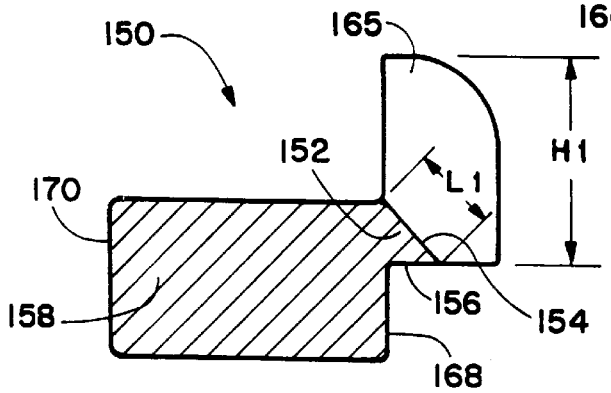
FIG. 14 is a cross sectional elevation view taken along lines 14—14 of FIG. 15.
Figure 15:
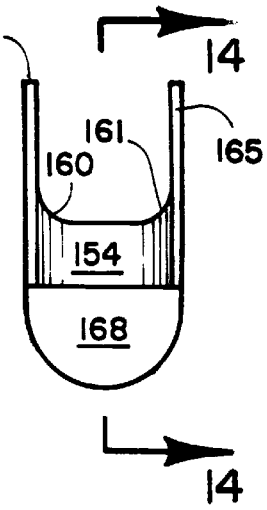
FIG. 15 is a front elevation view of the novel winged ramp assembly.
Figure 12:
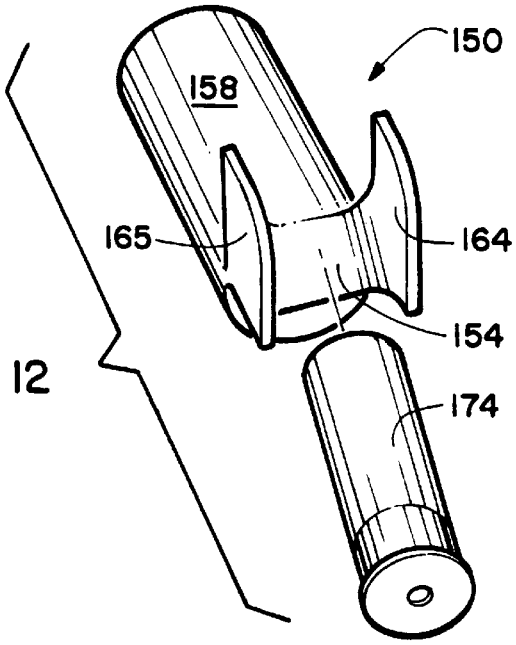
FIG. 12 is a front perspective view of the novel winged ramp assembly showing a shotgun shell traveling toward its concave top surface.
Figure 16:
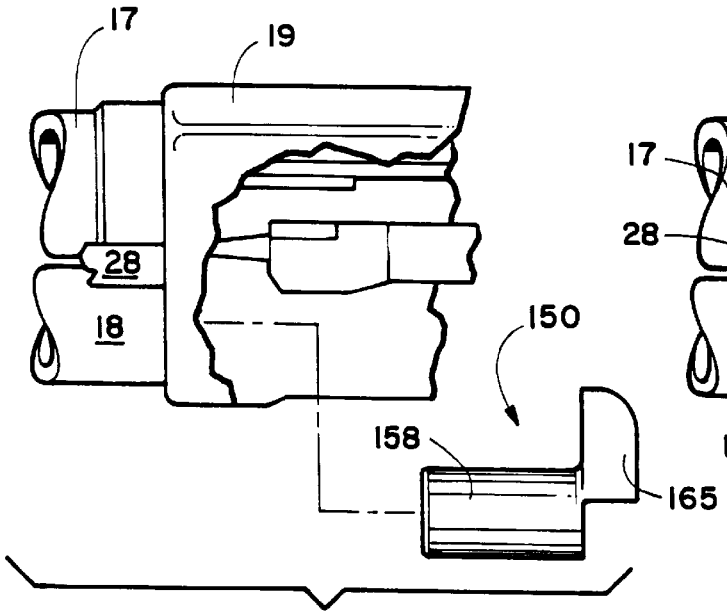
FIG. 16 is an exploded partial side elevation view showing the winged ramp assembly removed from the receiver of the shotgun.

Bolt assembly 120 is best illustrated by referring to FIGS. 8 and 9. Both of these Figures show the bolt assembly upside down for convenience in describing their structures. Bolt assembly 120 has a front wall 121 having a firing pin 122. A pair of extractors 124 extend later-ally from the opposite sides of bolt assembly 120 and function to grip the rear flange of the shotgun shell for purposes of eject-ing the shell. A slot 126 is formed in the bottom surface of bolt assembly 120 and a tang 128 is pivotally mounted about pin 129. Tang 128 extends forwardly and downwardly and has a front wall 130 and a cam surface bottom wall 131. A recess 133 is formed in the bottom of slot 126 for receiving the bottom end of spring 134. The top end of spring 134 is received in a recess 135 formed in tang 128.

A recess 138 is formed in the bottom surface of bolt assembly 120 and it detachably receives or captures the mating ridge structure 139 on the top wall of bolt slide 140 so that bolt assembly 120 and bolt slide 140 travel forwardly and rearwardly together. Bottom wall 141 of bolt slide 140 has a longitudinally extending concave bottom surface 142. Wings 144 extend laterally outwardly from the opposite side walls of bolt slide 140. Wings 144 are received in recesses 146 on the bottom surface of the respective slide action arms 28. When thus engaged, the rearward travel of slide action arms 28 will cause both bolt slide 140 and bolt assembly 120 to travel rearwardly. During this time, tang 128 is depressed upwardly into slot 126 until it has passed the rear end of feed lip assembly 102. spring 134 then forces tang 128 downwardly. On the forward motion of slide action arms 28, tang 128 will pass through slot 109 and engage the rear surface of the uppermost shotgun shell 75 causing it to travel forwardly until it hits ramp 26 which causes it to be directed upwardly into the rear end of gun barrel 17. Concave bottom surface 142 of bolt slide 140 allows bolt slide 140 to pass over feed lip assembly 102.

A novel winged ramp assembly 150 is illustrated in FIGS. 12–17 showing the manner in which it is removably received in the rear end of magazine tube 18. Winged ramp assembly 150 has a ramp body portion 152 having a concave top surface 154 and a bottom surface 156. An alignment rod plug member 158 extends from the rear end of ramp body portion 152. Concave top surface 154 has a length L1 in the range of 0.300–0.700 inches. Ramp body portion 152 has a left edge 160 and a right edge 161 and extending upwardly from the respective edges are left guide wing portion 164 and right guide wing portion 165. These guide wing portions have a height H1 and H1 is in the range of 0.300–1.000 inches. A relieved portion 168 is formed below bottom surface 156 and alignment rod plug member 158 has a rear end 170.

Figure 17:
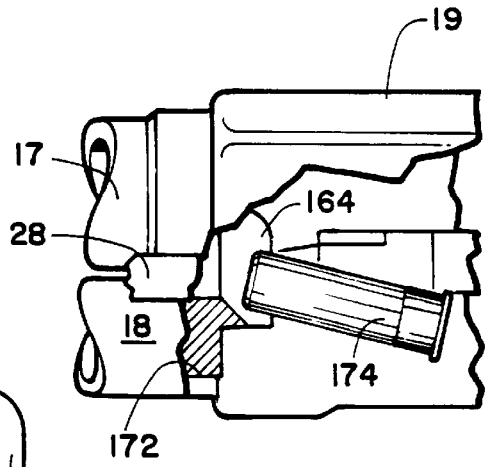
FIG. 17 is a partial side elevation view of the shotgun with portions broken away showing the winged ramp assembly having its alignment rod plug member inserted into the rear end of the magazine tube.

FIG. 17 shows the alignment rod plug member 158 telescopically received in the open rear end bore 172 of magazine tube 18. The shotgun shell 174 travels up through winged ramp assembly 150 and it will be received in the rear end of gun barrel 17. Guide winged portions 164 and 165 prevent the front end of the shotgun shell 174 from catching on the sides of the chamber and prevent the shotgun shell from getting sideways and thereby prevents jamming of the shotgun.

What is claimed is:

1. A magazine loaded shotgun comprising;

a receiver having a front end, a rear end, a top surface and a bottom surface;

an elongated gun barrel having a rear that is connected to the front end of said receiver;

a stock having a front end that is connected to the rear end of said receiver;

a trigger housing assembly having a front end and a rear end, said trigger housing assembly being mounted in a trigger housing assembly aperture in the bottom surface of said receiver;

an elongated shotgun shell magazine aperture in the bottom surface of said receiver and said shotgun shell magazine aperture is located forwardly of said trigger housing assembly aperture;

a bolt assembly having a front end, a rear end, a top surface and a bottom surface; a firing pin extending from the front end of said bolt assembly; a tang extending downwardly below the bottom surface of said bolt assembly and means for pivoting said tang upwardly into a slot in the bottom surface of said bolt assembly; said tang on said bolt assembly functions to engage the rear surface of a shotgun shell located in a feed lip assembly of a shotgun shell magazine and drag the shotgun shell forwardly into the rear end of the gun barrel of the shotgun so that the shotgun shell can be fired; and a winged ramp assembly having a ramp body portion having a front end, a rear end, a longitudinally extending concave top surface, a bottom surface, a left edge and a right edge; a left guide wing portion extends upwardly a predetermined distance from said left edge of said ramp body portion and a right guide wing portion extends upwardly a predetermined distance from said right edge of said ramp body portion; said winged ramp assembly being positioned in said receiver adjacent said front end of said receiver; said winged ramp assembly also being positioned forwardly of said shotgun shell magazine in said bottom surface of said receiver; said winged ramp assembly functions to guide a shotgun shell forwardly as it exits said shotgun shell magazine and into said rear end of said gun barrel and thus prevents a shotgun shell from jamming said shotgun.

2. A magazine loaded shotgun as recited in claim 1 wherein said shotgun has a magazine tube positioned below said gun barrel, said magazine tube having an open rear end that is in communication with the interior of said receiver; an elongated alignment rod plug member is secured to said rear end of said ramp body portion that can be telescopically received in said open rear end of said magazine tube.

3. A magazine loaded shotgun as recited in claim 2 wherein said ramp body portion, said left and right guide wing portions, and said rod plug member are integrally formed as a single structure.

4. A magazine loaded shotgun as recited in claim 1 wherein said top concave surface of said ramp body portion has a length L1 and L1 is in the range of 0.300–0.700 inches.

5. A magazine loaded shotgun as recited in claim 1 wherein said guide wing portions have a height H1 and H1 is in the range of 0.300–1.000 inches.

6. A magazine loaded shotgun as recited in claim 1 wherein there is a safety button mounted on the top surface of said receiver adjacent its rear end.

7. A magazine loaded shotgun as recited in claim 1 further comprising means on the bottom surface of said receiver for detachably securing the top end of a shotgun shell magazine to the bottom surface of said receiver.

8. A magazine loaded shotgun as recited in claim 1 further comprising a ramp positioned in said receiver adjacent the front end of said shotgun shell magazine aperture for directing a shotgun shell into the rear end of said gun barrel.

9. A magazine loaded shotgun as recited in claim 1 wherein said bolt assembly has a pair of laterally spaced shotgun shell extractors located adjacent said front end of said bolt assembly.

10. A magazine loaded shotgun as recited in claim 1 wherein said shotgun shell magazine further comprising a chimney portion that is detachably received in said shotgun shell magazine aperture.

11. A magazine loaded shotgun as recited in claim 1 further comprising a bolt slide having a bottom surface having a longitudinally extending concave recess that provides for clearance over a shotgun shell, means detachably securing said bolt slide to the bottom surface of said bolt assembly.

* * * * *